US006113249A

United States Patent [19]

Ziegler

[11] Patent Number: 6,113,249

[45] Date of Patent: Sep. 5, 2000

[54] LAMP AND PICTURE ASSEMBLY

[76] Inventor: Andrew Ziegler, 754 Rolling Hill Dr., Rivervale, N.J. 07675

[21] Appl. No.: 09/257,728

[22] Filed: Feb. 25, 1999

[51] Int. Cl.[7] ..... F21W 131/304

[52] U.S. Cl. ..... 362/253; 362/410; 362/806; 40/715

[58] Field of Search ..... 362/253, 410, 362/806; 40/725, 714, 715

[56] References Cited

U.S. PATENT DOCUMENTS

| | | | |
|---|---|---|---|
| 1,739,320 | 12/1929 | Lloyd . | |
| 3,116,027 | 12/1963 | Kleppin | 362/410 |
| 3,248,532 | 4/1966 | Bright | 362/806 X |
| 4,079,241 | 3/1978 | Marchio | 362/410 X |
| 4,117,533 | 9/1978 | Hagelthorn | 362/806 X |
| 5,247,745 | 9/1993 | Valentino | 40/152.2 |
| 5,513,084 | 4/1996 | Simpson | 362/806 X |

*Primary Examiner*—Laura K. Tso
*Attorney, Agent, or Firm*—Richard A Joel, Esq

[57] ABSTRACT

A lamp and picture assembly comprises a frame, a series of frames or surfaces in the lamp base to display pictures or photographs. The lamp illuminates both the room and the pictures or photographs. In one embodiment, the invention comprises a hollow metal leg mounted at one end to a lamp frame support at the upper end of a U-shaped member. Elongated channels are mounted within the interior of the legs to support a glass/photo/backing assembly. An electrical wire is run within the hollow leg to a light bulb mounted on the support. A lamp support is also mounted on the frame. Alternate embodiments include various bases which cooperate with a lamp to provide illumination for the frames and at the same time general lighting for the room. Multiple picture frames may be incorporated in a design and magnets may be employed to hold the frames or pictures in place.

11 Claims, 7 Drawing Sheets

LAMP AND PICTURE ASSEMBLY

CROSS-REFERENCE TO RELATED APPLICATIONS

None

STATEMENT REGARDING FEDERALLY SPONSORED RESEARCH OR DEVELOPMENT

Not applicable.

BACKGROUND OF THE INVENTION

1. Field of the Invention

This invention relates to lamps and particularly to lamps in combination with frames for photographs, etc.

2. Description of the Related Art Including Information Disclosed Under 37 CFR §§1.97–1.98

The prior art includes U.S. pat. No. 5,309,657 to Spencer which discloses a rotatable picture frame having a central post through which an electric wire is extended from the base to a receptacle mounted on the top of the post. The post illuminates photographs which rotate. U.S. Pat. No. 2,104,256 to Hambeck, discloses a picture stand in which a picture is interchangeably held between two glass plates and secured in a frame which has support lamps attached thereto.

U.S. Pat. No. 3,955,298 to Kapstad, discloses, in FIG. 1, a poster display frame with a lamp mounted onto one of the support frames. U.S. Pat. No. 4,817,315 to Kammerer, et al, discloses a three dimensional display device for lamp shades wherein a lamp is mounted in the center to project light through the lamp shade.

U.S. Pat. No. 2,549,928 to Reefe, discloses an illuminated picture frame, wherein a light is mounted at the base of the frame to project an illuminated image. U.S. Pat. No. 5,313,724 to Warner, is an another extension of the previously cited patent.

Also of interest are U.S. Pat. Nos. 1,406,464; 1,504,826; 1,884,290; 2,177,204; 2,823,477; and, 3,610.918

The foregoing patents, while in the same general area, fail to disclose the unique frame and lamp combination disclosed herein.

SUMMARY OF THE INVENTION

This invention comprises a unique lamp and frame combination wherein a lamp is mounted to a frame to illuminate a picture as well as the surrounding room.

The frame assembly comprises various designs which include a light bulb connected to a hollow leg through which a conductor is threaded. The upper portion of the frame is mounted to the hollow leg to form an assembly. In one embodiment, the frame comprises a U-shaped member having channels mounted along the legs thereof to hold a picture therebetween while in another embodiment, the frame comprises nesting steel plates which support the picture and glass while acting as a lamp base.

The frame may also comprise an angled metal member including a base, a frame and aperture extending upwardly at an angle thereto and an upper flange having the lamp mounted thereto. Magnets are used to secure a backing to the frame or vise versa.

Various frame configurations of a unique nature disclosed herein may be employed to mount frames thereto and the use of magnets is a prime means to removably mount pictures.

Accordingly, it is an object of this invention to provide a new and improved lamp and frame combination.

Another object of this invention is to provide a new and improved means to display illuminated pictures while simultaneously lighting the room.

A further object of this invention is to provide a new and improved lamp and frame combination wherein the lamp is mounted at one end of a hollow leg and the frame is connected thereto at its upper end.

A more specific object of this invention is to provide a new and improved lamp and frame combination wherein the frame is of a unique shaped configuration to which a lamp is mounted and pictures secured to the frame by various mounting means which may include magnets.

BRIEF DESCRIPTION OF THE DRAWINGS

The above and other objects and advantages of this invention may be more clearly seen when viewed in conjunction with the accompanying drawings wherein:

FIG. 3*a* is a perspective view of a multi-frame embodiment of the invention while

FIG. 4*a* is a front view of an embodiment wherein the frames are mounted to a floor lamp assembly by magnets while

FIG. 5*a* is a perspective view of an embodiment of the invention with a unique base while

DETAILED DESCRIPTION OF THE INVENTION

Figure 1B:
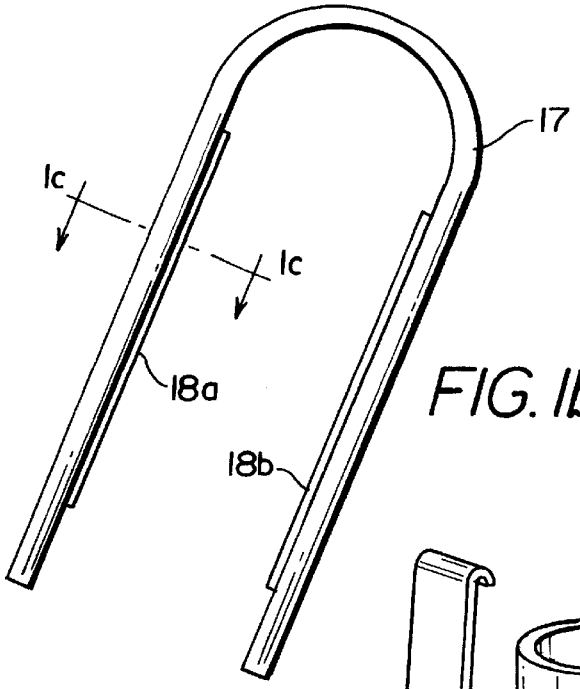
FIG. 1*b* is a perspective view of the U-shaped support with channels to support a picture.
Figure 1C:
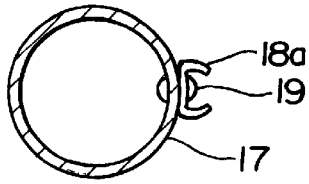
FIG. 1*c* is a view taken along the line of c—c of FIG. 1*b;*
Figure 1A:
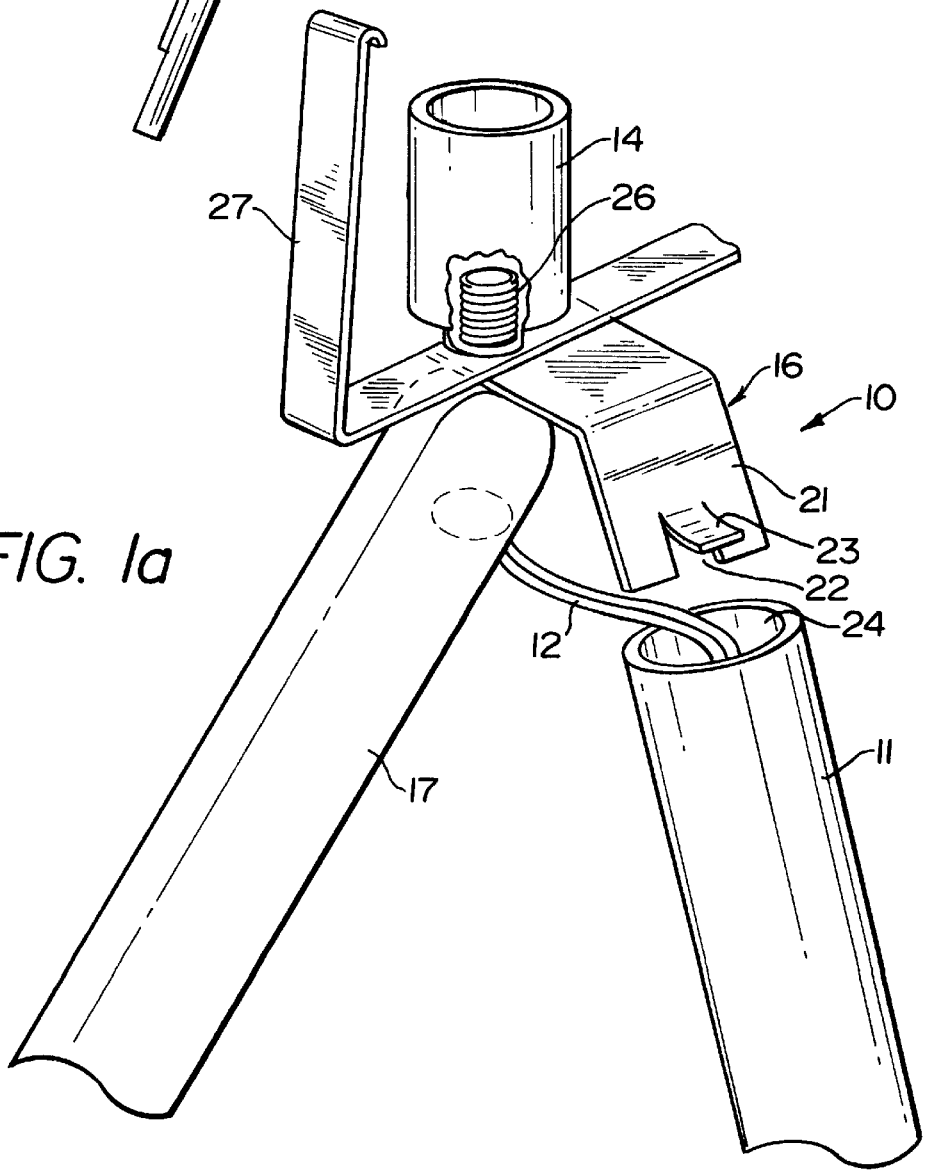
FIG. 1*a* is a perspective view of a first embodiment of the invention with portions shown in phantom and cross-section.

Referring now to FIG. 1 of the drawings, the picture frame and lamp invention 10 comprises a hollow leg 11 having a conductor wire 12 running within the leg aperture 13 to a light bulb support fixture 14 at its upper end. The leg 11 is mounted to an angled frame support 16 at its upper end. The frame 16 includes a U-shaped member 17 with interior channels 18*a* and 18*b* secured to the member 17 with rivets 19. The glass/photo/metal backer (not shown) will be held in place by the channels 18*a*, 18*b*. More specifically, the downward extending portion 21 includes a slot 22 formed by bending a portion 23 of the frame 16 outwardly to form a passage for the wire 12. The portion 23 is then inserted into the leg aperture 24. The upper portion 26 slips over the threaded element 26 of the main lamp base comprising the U-shaped member 17. The angular shade support 27 slips over element 26 and then the light bulb support fixture 14 is threaded in place.

Figure 2:
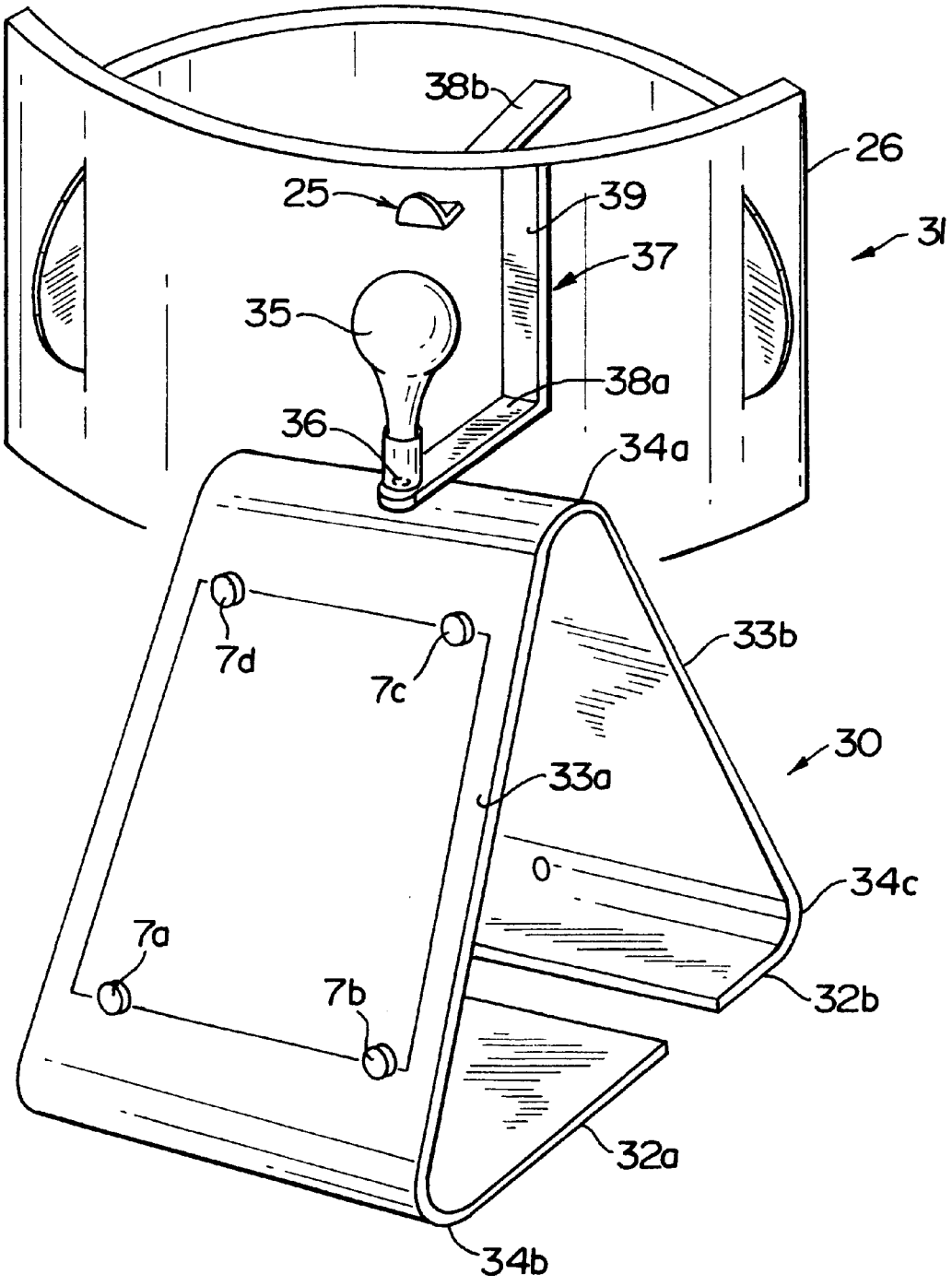
FIG. 2 is a perspective view of an alternate embodiment of the invention.

In FIG. 2, a substantially triangular one piece steel frame 30 supports a lamp 31 at its upper end. The frame 30 includes base portions 32*a* and 32*b* and upwardly extending inclined walls 33*a* and 33*b*. Each of the corner angles 34*a*, 34*b* and 34*c* are rounded for ease of manufacturing and aesthetic appearance. A light bulb 35 may be mounted on the upper angle 34*a* and a shade support 37 mounted about the bulb base 36. The shade support 37 comprises a perpendicular base 38*a*, a vertical portion 39 and a horizontal portion 38*b* extending parallel to base 38*a*. The shade 26 is mounted to portion 25. Pictures may be mounted to the inclined metal walls 33*a*, 33*b* using magnets 7*a–d*.

Figure 3B:
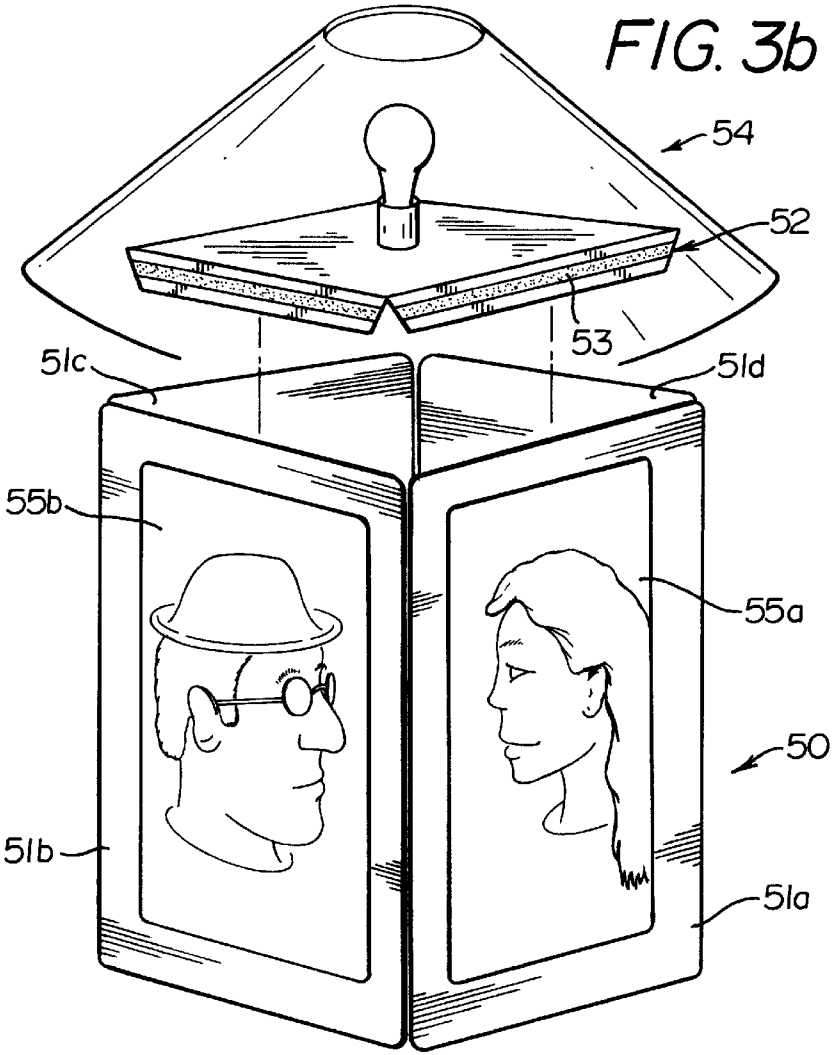
FIG. 3*b* is a perspective view of another multi-frame embodiment of the invention.
Figure 3A:
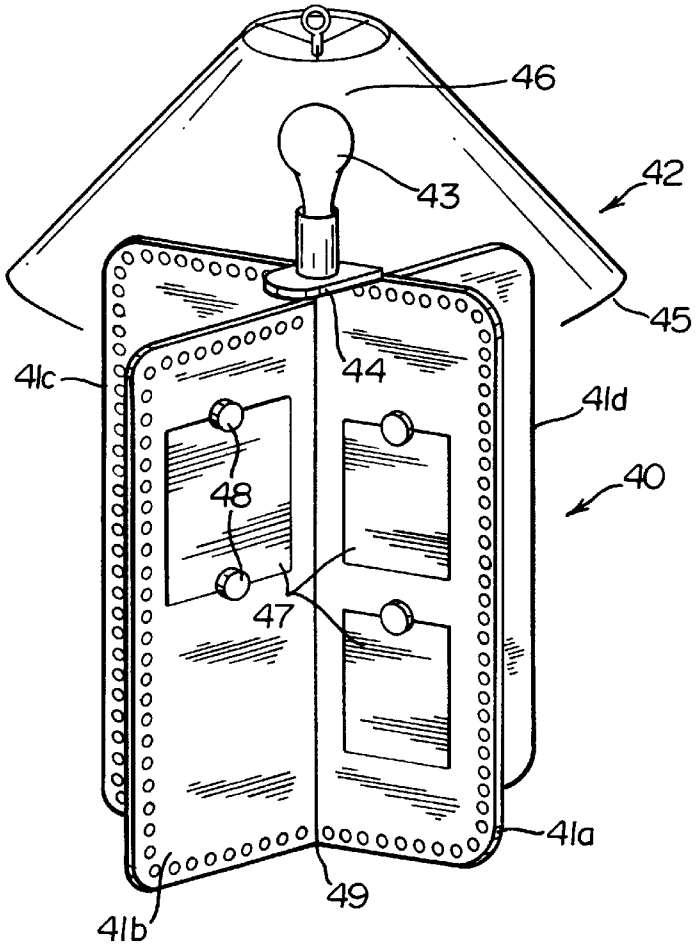

FIGS. 3*a* and 3*b* depict multiple photograph or picture lamps 40 and 50 respectively. Lamp 40 comprises four vertical walls 41*a–d* with 41*a* and 41*c* being perpendicular to 41*b* and 41*d* respectively. The walls 41*a–d* are joined at one end 49 with the lamp 42 mounted at the apex thereof. The light bulb 43 is mounted on a bracket 44 with the shade 45 held in position by a harp support 46. The pictures 47 are held in position on the walls 41*a–d* by magnets 48.

In FIG. 3*b*, the frame assembly 50 includes four rectangular walls 51*a–d* joined at their edges to form an enclosed polyhedron. The top 52 and bottom (not shown) include magnets 53 to hold the walls 51*a–d* in position. A lamp 54 is mounted to the top 52 and illuminates the pictures 55*a*, b, etc.

Figure 4A:
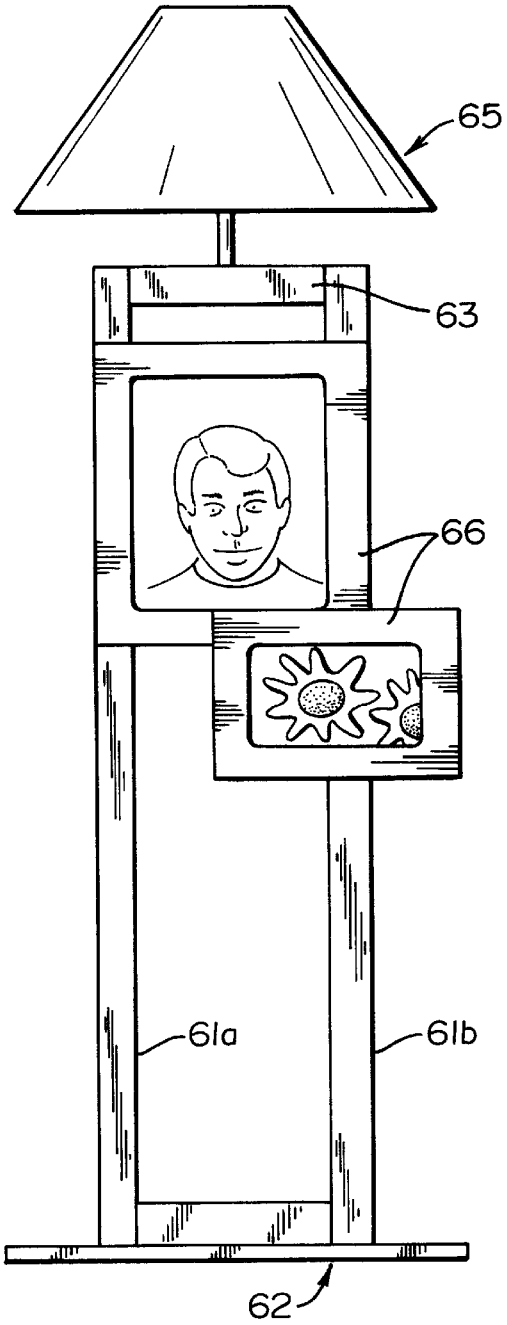
Figure 4B:
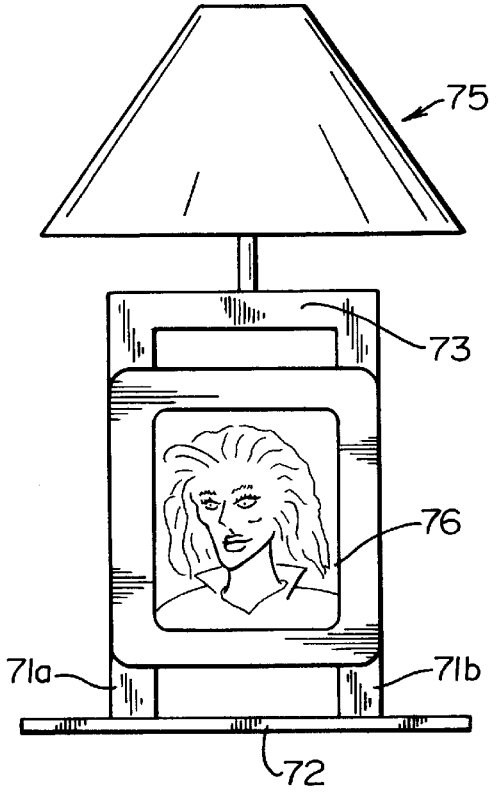
FIG. 4*b* is a table lamp version of the assembly.

FIGS. 4*a* and 4*b* depict respectively a floor lamp 65 and a table lamp 75 having spaced elongated members 61*a,b* and 71*a,b* respectively extending vertically upward from bases 62 and 72. A cross member 63 and 73 joins the elongated members 61*a* and 61*b* and 71*a* and 71*b*. A lamp 65 or 75 is mounted to the respective cross members 63 and 73. Pictures 66 and 76 are mounted to or between the vertical members 61*a*, 61*b*, 71*a* and 71*b*.

Figure 5B:
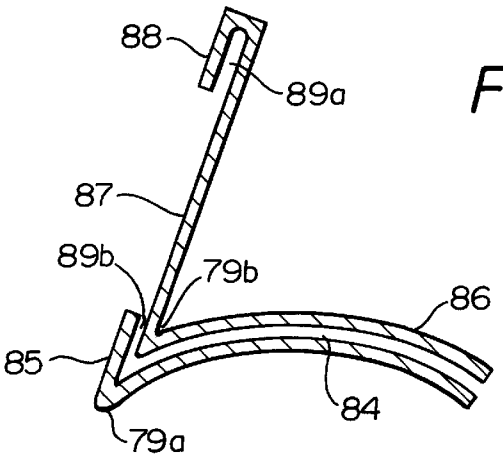
FIG. 5*b* is a cross-sectional view of the base and FIG. 5C is a bottom view of the base.
Figure 5C:
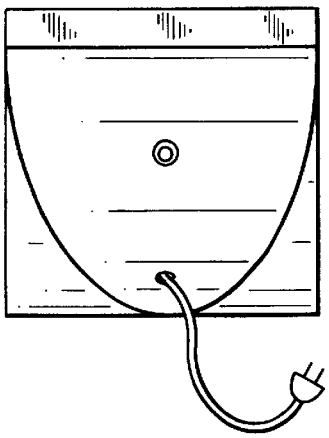
Figure 5A:
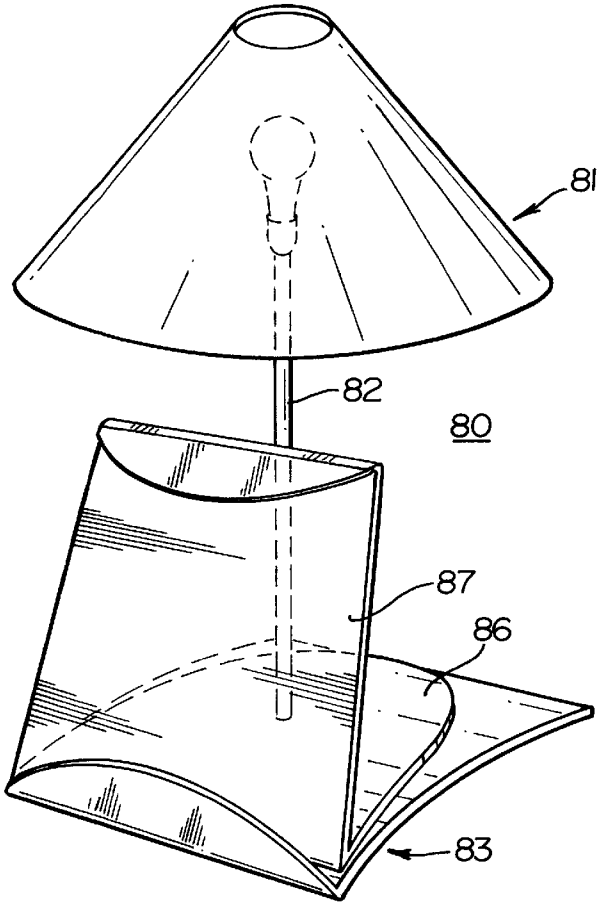

FIGS. 5*a–c* depict a frame assembly 80 wherein a lamp 81 is mounted on a rod 82 extending upwardly from a base 83. The base 83 comprises a curved bottom plate 84 having an angle portion 85 extending upwardly at one end and a curved top plate 86 having an upwardly extending frame portion 87 with a downwardly extending portion 88 forming a picture slot 89*a*. The top plate 86 rests on the bottom plate 84 with the forward angles 79*a* and 79*b* forming a slot which cooperates with slot 89*a* to hold a picture.

Figure 6:
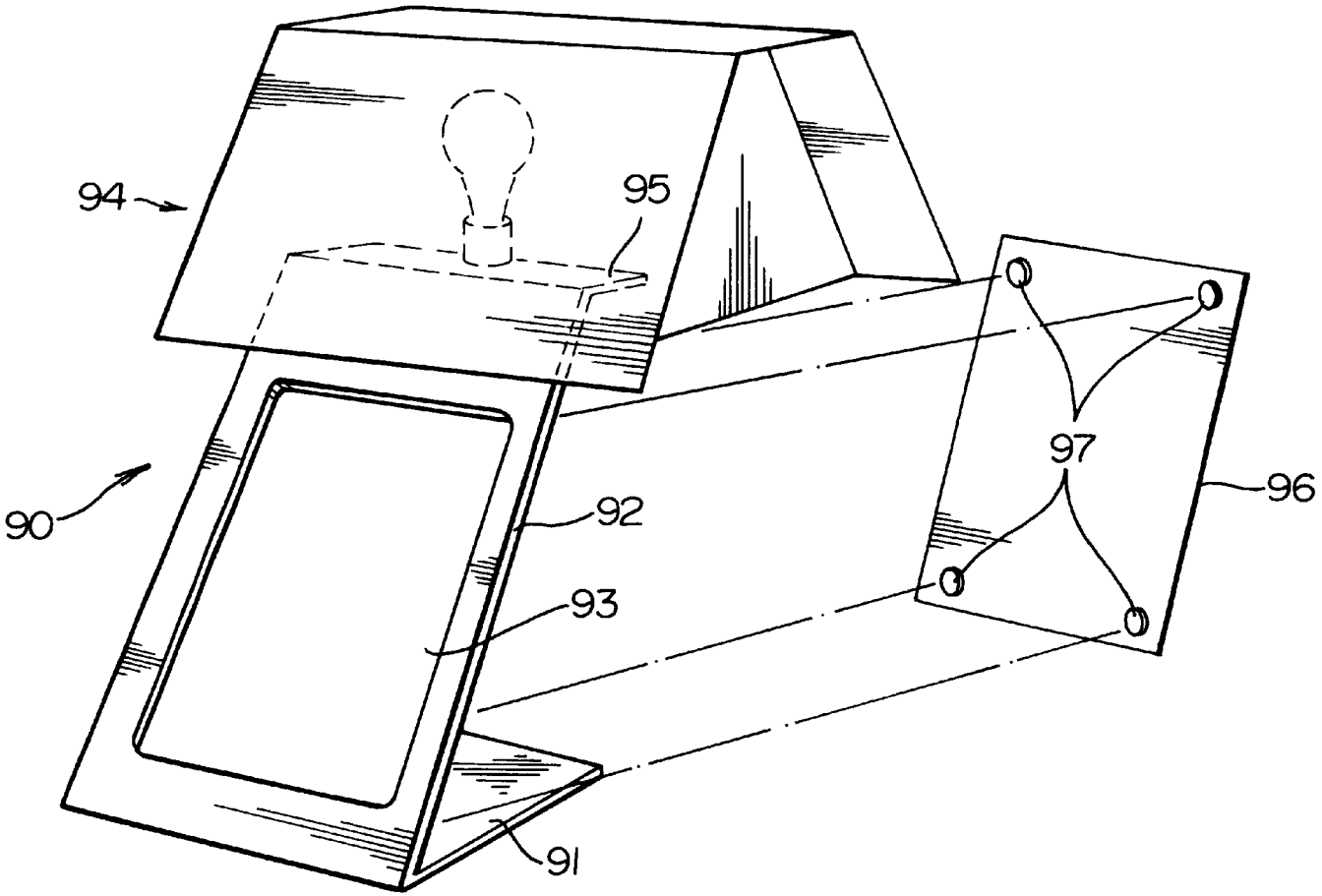
FIG. 6 is an exploded view of another embodiment of the invention.

FIG. 6 depicts a frame assembly 90 comprising a base 91, a frame portion 92 with aperture 93 extending upwardly at an angle and an upper portion 95 extending rearwardly parallel to base 91. A lamp 94 is mounted on the upper portion 95. A back plate 96 is secured to the frame portion 92 by magnets 97 to hold a picture (not shown) in the aperture 93.

Figure 7:
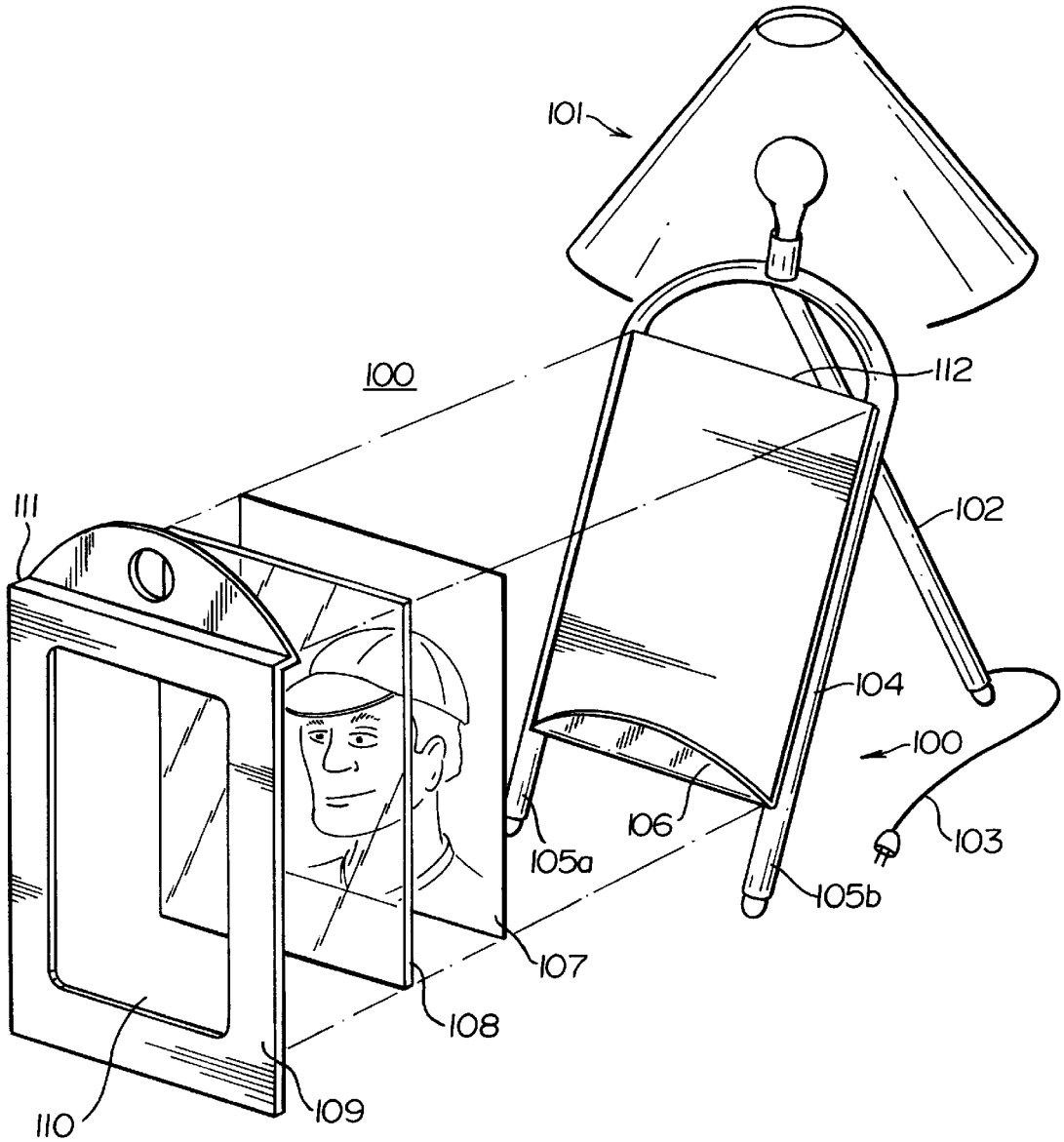
FIG. 7 is an exploded view of an alternate embodiment of the invention.

FIG. 7 depicts a frame assembly 100 with a lamp 101 mounted on the juncture of leg 102 with wire 103 extending therethrough and frame member 104. The rear frame member 104 includes downwardly extending legs 105*a* and 105*b* and a ledge 106 on which is mounted a picture 107, a glass sheet 108 and an outer frame member 109 having an aperture 110 extending therethrough. The upper portion of member 109 includes a ledge 111 which snaps onto the top 112 of member 104 to hold the picture 107 in place.

While the invention has been explained by a detailed description of certain specific embodiments, it is understood that various modifications and substitutions can be made in any of them within the scope of the appended claims which are intended also to include equivalents of such embodiments.

What is claimed, is:

1. A lamp and picture frame assembly comprising:

a frame having a substantially rectangular back plate with an upper portion and a lower portion, said lower portion being pivotable outwardly to form a supporting ledge, a picture and a glass plate mounted thereover on the ledge and an outer frame plate having a central picture aperture and an upper portion having an L-shaped configuration mounted thereover with said upper portion being friction snapped over the back plate;

a supporting leg pivotally mounted to the upper portion of the back plate, said leg having an elongated aperture extending therethrough;

a conductor wire extending through said elongated leg aperture; and, a lamp connected to said wire and mounted to junction of the supporting leg and back plate.

2. A lamp and picture frame assembly comprising:

a frame having an upper and a lower portion;

a lamp mounted to the upper portion of the frame wherein the lower portion of said frame provides a support for said lamp, and picture mounting means on the lower portion wherein the lamp provides illumination therefor.

3. A lamp and picture frame assembly in accordance with claim 2 wherein:

the frame comprises a single formed member having a base at each end, upwardly extending inwardly inclined walls at an apex wherein said walls are joined;

magnet means for attaching pictures to the inclined walls; and, a lamp mounted on the apex of the walls.

4. A lamp and picture frame assembly in accordance with claim 3 wherein:

the lamp comprises a light bulb mounted on the apex, a shade support extending outwardly at a right angle, an upwardly extending portion of said supporting extending upwardly at a predetermining distance from the bulb an a horizontal portion mounted to the upwardly extending portion and a shade mounted to the horizontal portion.

5. A lamp and picture frame assembly in accordance with claim 2 wherein:

the frame comprises a plurality of rectangular vertical members having inner and outer edges, said rectangular members being joined along their inner edges and having a top edge portion and a lamp mounting on said top edge portion.

6. A lamp and picture frame assembly in accordance with claim 2 wherein:

the frame comprises a plurality of rectangular members having outer vertical edges, and each member being joined to an adjacent member along said edges to form an open ended polyhedron; and, a top having downwardly extending magnetized sides, said sides engaging the rectangular members as the top is mounted to the open end of the polyhedron and a lamp mounted on said top.

7. A lamp and picture frame assembly in accordance with claim 2 wherein:

the frame comprises a base, spaced members extending upwardly from said base, and an upper portion joining said spaced members wherein pictures are mounted to the upwardly extending spaced members.

8. A lamp and picture frame assembly in accordance with claim 2 wherein:

the lower portion of the frame comprises a first member having a curved base and one end having an inclined upwardly extending portion for a short distance;

a second member having a curved base mounted on top of and engaging the curved base of the first member and an inclined upwardly extending portion having a U-shaped upper end forming a nest for a picture together with the upwardly extending portion of the first member; and, a hollow rod extending upwardly from the curved base and having the lamp mounted thereon.

9. A lamp and picture frame assembly in accordance with claim 2 wherein:

the frame comprises a base, a portion extending upwardly and inclined at an angle to the base, and having a picture mounting aperture located thereon and an upper portion extending rearwardly parallel to the base, and a back plate removably mounted over said aperture.

10. A lamp and picture frame assembly in accordance with claim 2 wherein:

the frame comprises a U-shaped support member having legs which engage a support surface, a back plate having a lower edge mounted between said legs, a picture, a glass sheet, and a outer frame member having a base and an aperture extending therethrough and an inwardly extending upper portion wherein the base engages the ledge and the inwardly extending portion snap fits over the back plate to hold the picture in position, and a lamp mounted at the base of the U-shaped member and a downwardly extending rod engaging the lamp mounting and having an electric conductor mounted thereon.

11. A lamp and picture frame assembly comprising:

a U-shaped support member having opposing channels mounted to the interior legs of the U-shaped member, a glass/photo/backing mounted within the channels at each end and an upper end having a threaded element extending upwardly therefrom;

a frame support member having a downwardly extending portion, a lower edge and a slot formed in said lower edge, said support member being mounted to said threaded element;

a hollow rear support leg and a wire extending through said leg, wherein the downwardly extending portion of the frame support member is inserted in the hollow leg and the wire extends through the slot;

a lamp shade support mounted to the threaded element; and, a light bulb fixture mounted to said threaded element.

* * * * *